US007749101B2

(12) United States Patent
Imamoto et al.

(10) Patent No.: US 7,749,101 B2
(45) Date of Patent: Jul. 6, 2010

(54) WOOD-TYPE GOLF CLUB HEAD

(75) Inventors: Yasunori Imamoto, Tokyo (JP); Hideo Shimazaki, Tokyo (JP); Hideo Matsunaga, Saitama (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 448 days.

(21) Appl. No.: 11/495,587

(22) Filed: Jul. 31, 2006

(65) Prior Publication Data

US 2007/0049400 A1 Mar. 1, 2007

Related U.S. Application Data

(60) Provisional application No. 60/750,396, filed on Dec. 15, 2005.

(30) Foreign Application Priority Data

Aug. 23, 2005 (JP) ..... 2005-241124
Apr. 17, 2006 (JP) ..... 2006-113176

(51) Int. Cl.
*A63B 53/04* (2006.01)

(52) U.S. Cl. ..... 473/332; 473/345

(58) Field of Classification Search ..... 473/324–350
See application file for complete search history.

(56) References Cited

U.S. PATENT DOCUMENTS 1,774,590 A * 9/1930 Buhrke ..... 473/328
3,143,349 A * 8/1964 Macintyre ..... 473/338
4,085,934 A * 4/1978 Churchward ..... 473/338
4,811,950 A * 3/1989 Kobayashi ..... 473/335
5,255,913 A * 10/1993 Tsuchida ..... 473/329
5,316,305 A * 5/1994 McCabe ..... 473/332
5,431,401 A * 7/1995 Smith ..... 473/251
5,518,243 A * 5/1996 Redman ..... 473/334
6,146,287 A * 11/2000 Rugge et al. ..... 473/334
6,257,991 B1 7/2001 Ortiz
6,991,560 B2 * 1/2006 Tseng ..... 473/332
7,004,852 B2 * 2/2006 Billings ..... 473/332
2003/0236133 A1 12/2003 Shimazaki et al.
2004/0043830 A1 3/2004 Imamoto
2005/0026722 A1 * 2/2005 Imamoto et al. ..... 473/345
2005/0090333 A1 4/2005 Shimazaki et al.
2005/0148405 A1 * 7/2005 Imamoto ..... 473/338
2005/0192116 A1 9/2005 Imamoto
2005/0197208 A1 * 9/2005 Imamoto ..... 473/349

FOREIGN PATENT DOCUMENTS

JP 08257175 A * 10/1996

(Continued)

*Primary Examiner*—Alvin A Hunter
(74) *Attorney, Agent, or Firm*—Sughrue Mion, PLLC

(57) ABSTRACT

A wood-type golf club head includes a metal sole portion, an elastic body and a weight member. At least one recess is defined in the metal sole portion to extend in a front-rear direction over at least half-length of a front-rear length of the sole portion. The elastic body is embedded in the recess. The weight member is fixed to the recess to cover the elastic body. The weight member is flush with the sole portion. A total area of the recess is in a range of 10% to 60% of that of the sole portion.

20 Claims, 9 Drawing Sheets

FOREIGN PATENT DOCUMENTS

| | | | |
|---|---|---|---|
| JP | 9-140837 | A | 6/1997 |
| JP | 11-262548 | A | 9/1999 |
| JP | 2001-129130 | A | 5/2001 |
| JP | 2001-204858 | A | 7/2001 |
| JP | 2004-41707 | A | 2/2004 |
| JP | 2004-089434 | A | 3/2004 |
| JP | 2005-245519 | A | 9/2005 |

* cited by examiner

WOOD-TYPE GOLF CLUB HEAD

This application is based upon the prior Japanese Patent Applications No. 2005-241124 on Aug. 23, 2005 and No. 2006-113176 on Apr. 17, 2006, and U.S. Provisional Application No. 60/750,396 filed on Dec. 15, 2005, the entire contents of which are incorporated herein by reference.

BACKGROUND OF THE INVENTION

1. Field of the Invention

The invention relates to a wood-type golf club head and, more particularly to a wood-type golf club head, which is suitable for use in a driver or a fairway wood whose sole is made of a metal material.

2. Description of the Related Art

US 2004/043830 A discloses an iron-type golf club head, which incorporates an elastic body (made of a thermoplastic elastomer) having a JIS-C hardness of 15 to 80 (preferably 20 to 60) in order to suppress vibration occurring when the club head strikes the ball to thereby increase carry and improve the impact feel.

U.S. Pat. No. 6,257,991 discloses another wood-type golf club head in which weights are attached to plural recesses defined in a sole portion. The weights are made of tungsten copper, and the largest weight has a rectangular shape of 1.1815 inches sole by brazing.

SUMMARY OF THE INVENTION

The wood-type golf club head of U.S. Pat. No. 6,257,991 does not have a function of suppressing vibration of a body including the sole portion. On the other hand, the elastic body of US 2004/043830 A has too small ratio of its area to an area of the sole portion, to suppress vibration of the body sufficiently.

The invention provides a wood-type golf club head whose center of gravity is lower and vibration suppression effect is enhanced by increasing a ratio of the area of an elastic body and a weight to the total area of the sole portion.

According to one embodiment of the invention, a wood-type golf club head includes a metal sole portion, an elastic body and a weight member. At least one recess is defined in the metal sole portion to extend in a front-rear direction over at least half-length of a front-rear length of the sole portion. The elastic body is embedded in the recess. The weight member is fixed to the recess to cover the elastic body. The weight member is flush with the sole portion. A total area of the recess is in a range of 10% to 60% of that of the sole portion.

According to this structure, the weight member occupies a relatively large area while being flush with the sole portion without protruding from the sole portion. Thus, the center of gravity is made sufficiently low. Further, the elastic body that is housed in each recess extends parallel with the sole portion and occupies a relatively large area. Hence, useless vibration of the body including the sole portion can be suppressed, to thereby improve the impact feel and increase carry.

DETAILED DESCRIPTION OF EMBODIMENTS OF THE INVENTION

Embodiments of the invention will be hereinafter described with reference to the drawings.

Figure 1:
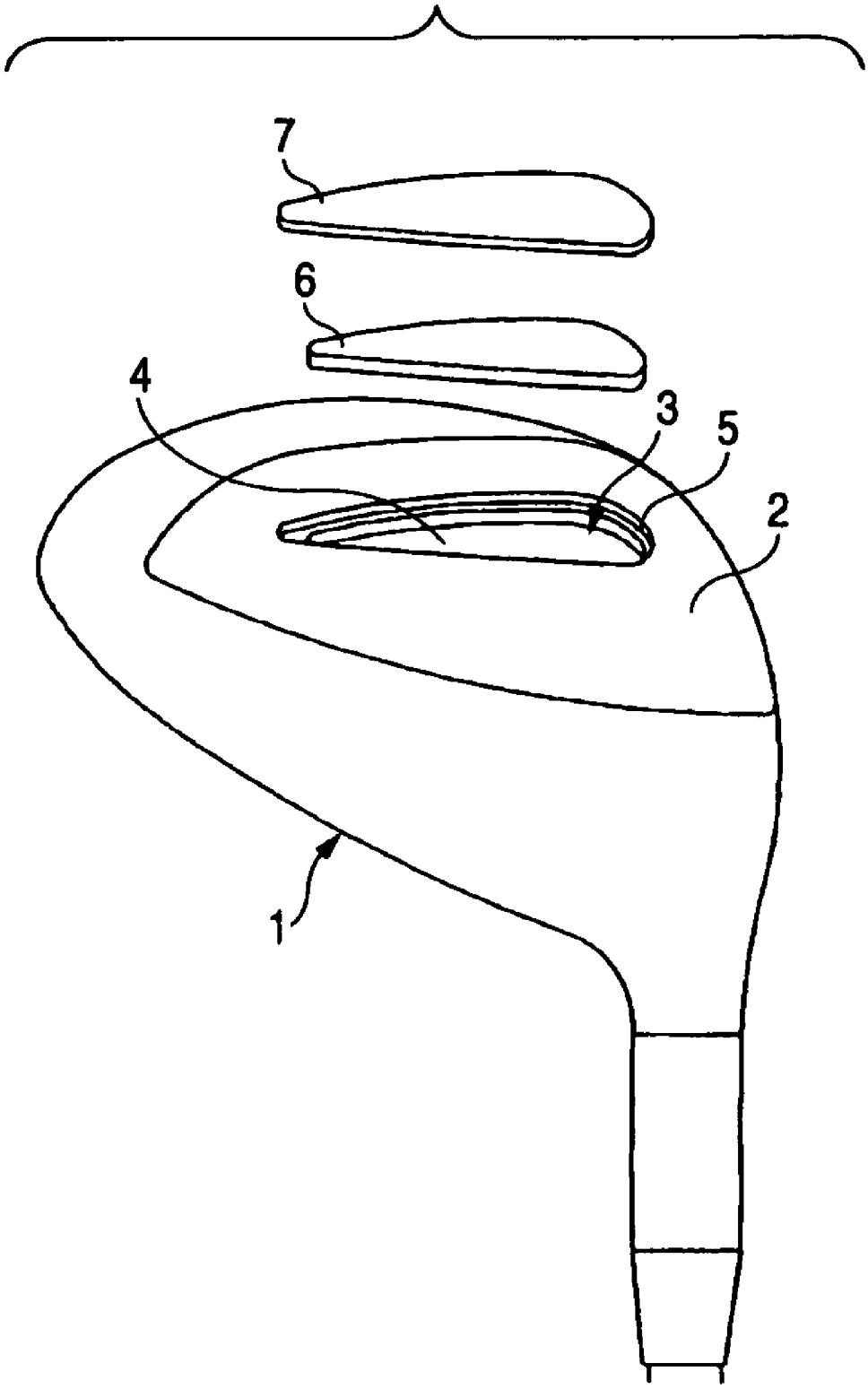
FIG. 1 is a perspective view of a head.

FIG. 1 is an exploded perspective view of a body 1 of a head as viewed from a side of a sole portion 2. An elliptical or waterdrop-shaped recess 3, which tapers down toward the rear end (opposite to the clubface), is formed so as to occupy a central portion of the sole portion 2 and to extend in the front-rear direction over a half or more (in this example, 70% to 80%) of the front-rear length of the sole portion 2. The recess 3 is formed with a step portion 5, which is located between a bottom 4 of the recess 3 and a surface of the sole portion 2 (i.e., at a position, which is distant from the bottom 4 by the thickness of an elastic body 6). The step portion 5 extends along the entire circumference of the recess 3. The elastic body 6 is embedded on the bottom 4 of the recess 3 and a weight member 7 is press-fitted into the recess 3 so as to cover the elastic body 6 and abuts against the step portion 5. The sole portion 2 is made of a metal material (in the illustrated example, stainless steel 17-4ph). The area of the recess 3 is equal to 10% to 60% of the entire area of the sole portion 2.

It is preferable that the elastic body 6 be made of an elastic elastomer, examples of which are styrene elastomer, olefin elastomer, urethane elastomer, ester elastomer, amide elastomer, 1,2-polybutadiene, ionomer resin, and transpolyisoprene. Among these examples, urethane elastomer, amide elastomer, and 1,2-polybutadiene are particularly suitable. In the case of a thermoplastic elastomer, it is preferable that the softening temperature be higher than 80° C. This is to prevent an event that the elastomer portion of each of golf clubs that are placed in the trunk of a car is deformed plastically in the summer daytime. A good impact feel is obtained if the elastic body 6 has a JIS-C hardness of 15 to 80 (in particular, 20 to 60). Alternatively, the elastic body 6 may be made of vulcanized rubber such as rubber containing butyl rubber. The vulcanized rubber has less temperature dependency than thermoplastic elastomer. If the elastic body 6 is made of the vulcanized rubber, such an elastic body 6 less depends on temperatures in hardness than one made of elastomer. The term "hardness" means how much a material gets harder as temperature decreases and gets softer as temperature increases.

Also, if the elastic body 6 is made of viscoelastic material, vibration of the head can be suppressed effectively. Specifically, examples of the viscoelastic material include butyl rubber, chlorosulfonated polyethylene, acrylonitrile-butadiene rubber, natural rubber, silicone rubber and styrene-based rubber. Particularly, butyl rubber, chlorosulfonated polyethylene and acrylonitrile-butadiene rubber are preferable. Alternatively, natural rubber may be mixed with butyl rubber.

The viscoelastic material used as the elastic body 6 may have loss factor (tan δ) equal to or larger than 0.3 in a range of −40° C. to −10° C. or have a peak value of loss factor (tan δ) equal to or larger than 0.5 in the range of −40° C. to −10° C.

A ratio of a loss shear modulus (G") to a storage shear modulus (G'), that is, G"/G' is called loss tangent (loss factor), and expressed by tans. The loss factor (tan δ) of the viscoelastic material represents how much energy the material absorbs (changes into heat) when the material deforms. The loss factor (tan δ) of the viscoelastic material can be measured with a dynamic viscoelastic measurement device. As tan δ increases, the material absorbs larger energy, indicates smaller rebound resilience in a shock dumping test and indicates smaller resonance magnification in a shaking test.

It is preferable that the weight member 7 be made of a tungsten-nickel alloy or a tungsten-copper alloy. It is also preferable that these materials have a specific gravity of 9 to 12. Portions of the body 1 other than the sole portion 2 may be made of the same material as the sole portion 2 or the body 1 may be a composite body made of different materials. In terms of lowering the center of gravity of the golf club head, it is preferable that the weight member 7 has a thickness in a range of 0.5 mm to 2.0 mm, especially in a range of 1.0 mm to 2.0 mm. The elastic body 6 has a thickness in a range of 0.8 mm to 2.5 mm, preferably in a range of 1.0 mm to 2.0 mm. Also, the thickness and weight of the weight member 7 may increase as the loft angle increases. This is because, in the case of a fairway wood, the head volume decreases and the head weight increases as the loft angle increases.

Figure 2:
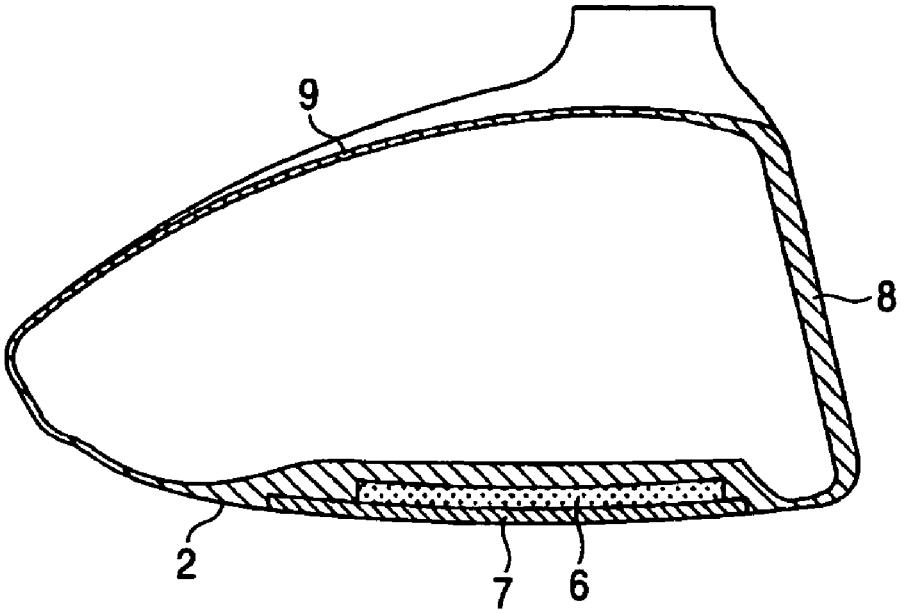
FIG. 2 is a side sectional view of the head.

FIG. 2 is a side sectional view of the head and shows a state where the elastic body 6 of about 2 mm in thickness and about 1 g in weight is embedded in the recess 3 and the weight member 7 having about 10 g in weight and made of a tungsten-nickel alloy is press-fitted into the recess 3. Reference numerals 8 and 9 denote a face portion and a crown portion, respectively. The crown portion 9 is formed by stainless steel casting so as to be made as thin as possible. In a preferred embodiment, the crown portion has a thickness in a range of 0.4 mm to 0.6 mm (in one exemplary embodiment of the head shown in FIG. 2, the crown portion 9 has 0.5 mm in thickness), whereby its weight is reduced. The thickness distribution of the sole portion 2 is designed by a computer simulation so as to provide an optimum weight distribution, whereby a high moment of inertia, which provides superior directional stability, is realized while sufficient maneuverability, which is required by professional and experienced players, is attained. Whereas a weight reduction of about 5 g is attained by the above-described crown portion 9, the weight member 7, which has about 10 g in weight and is made of a tungsten alloy, is press-fitted into the sole portion 2 at the center. Furthermore, the sole portion 2 having an optimum thickness distribution provide a low center of gravity. As a result, long carry is attained by a strong trajectory with a large launch angle and low spin amount.

Figure 3A:
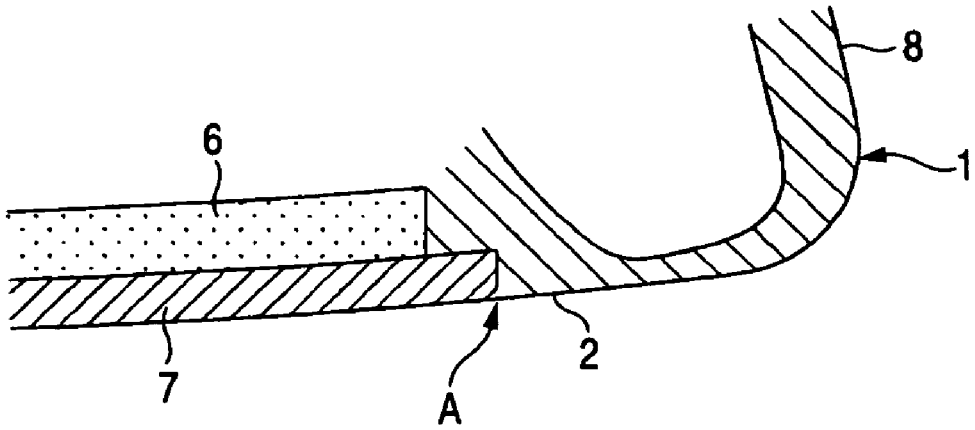
FIGS. 3A-3E are enlarged sectional views of a position where a weight member is fixed.

FIG. 3A is an enlarged view showing a portion A where the periphery of the recess 3 of the sole portion 2 caulks the periphery of the weight member 7. Specifically, the recess 3 has a two-step structure, that is, has a small recess 3*a* in which the elastic body 6 is placed and a large recess 3*b* in which the weight member 7 is placed. The periphery of the weight member 7 is in pressure contact with the step portion 5 defined between the small recess 3*a* and the large recess 3*b* (see FIG. 1). A width x of the step portion 5 in section is preferably in a range of 1 mm to 5 mm (see FIG. 3A). The method for fixing the weight member 7 to the recess 3 is not limited to press-fitting or caulking and may be such a known method as bonding.

Figure 3B:
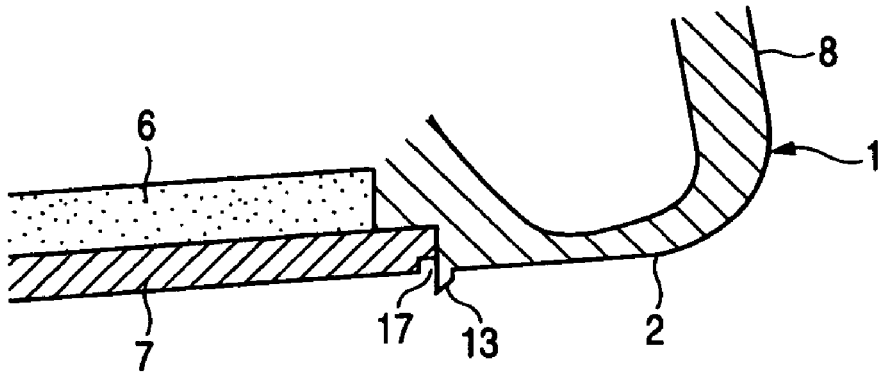
Figure 3C:
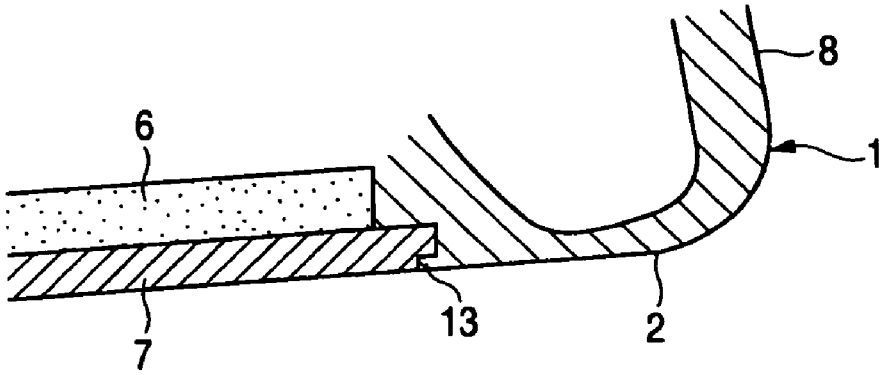

FIG. 3B shows an example of the caulking. Convex 13 continuously extends in the outer periphery of the recess 3. A notch 17 is formed in the outer peripheral portion of the weight member 7. After the elastic body 6 and the weight member 7 are inserted into the recess 3, the convex 13 is pressed and deformed plastically so as to embed the notch 17 (see FIG. 3C). As a result, the weight member 7 is secured in the recess 3.

Figure 3D:
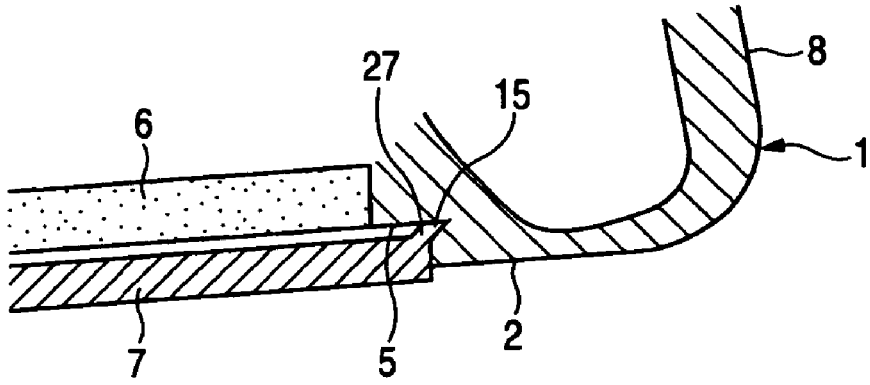
Figure 3E:
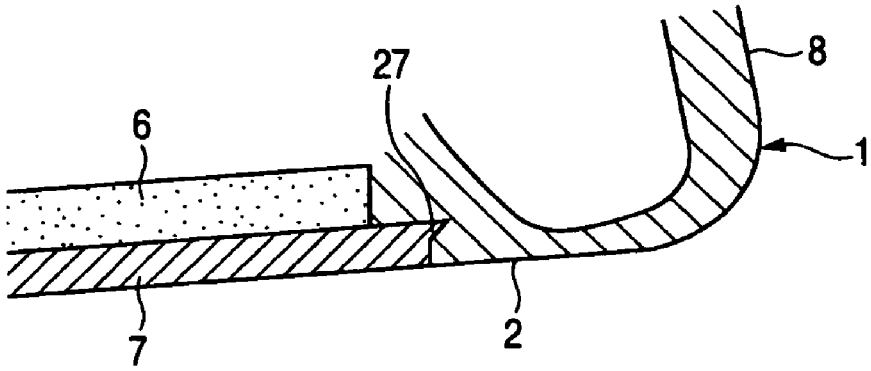

FIG. 3D shows an example of the press-fitting. In this example, a groove 15 is formed in the outer periphery of the step portion 5. The weight member 7 has a protrusion 27 at an end portion thereof on its surface facing the elastic body 6. When the weight member 7 is press-fitted into the recess 3, the weight member 7 (the protrusion 27) deforms plastically to enter into the groove 15 (see FIG. 3E). As a result, the weight member 7 is secured in the recess 3.

Figure 4:
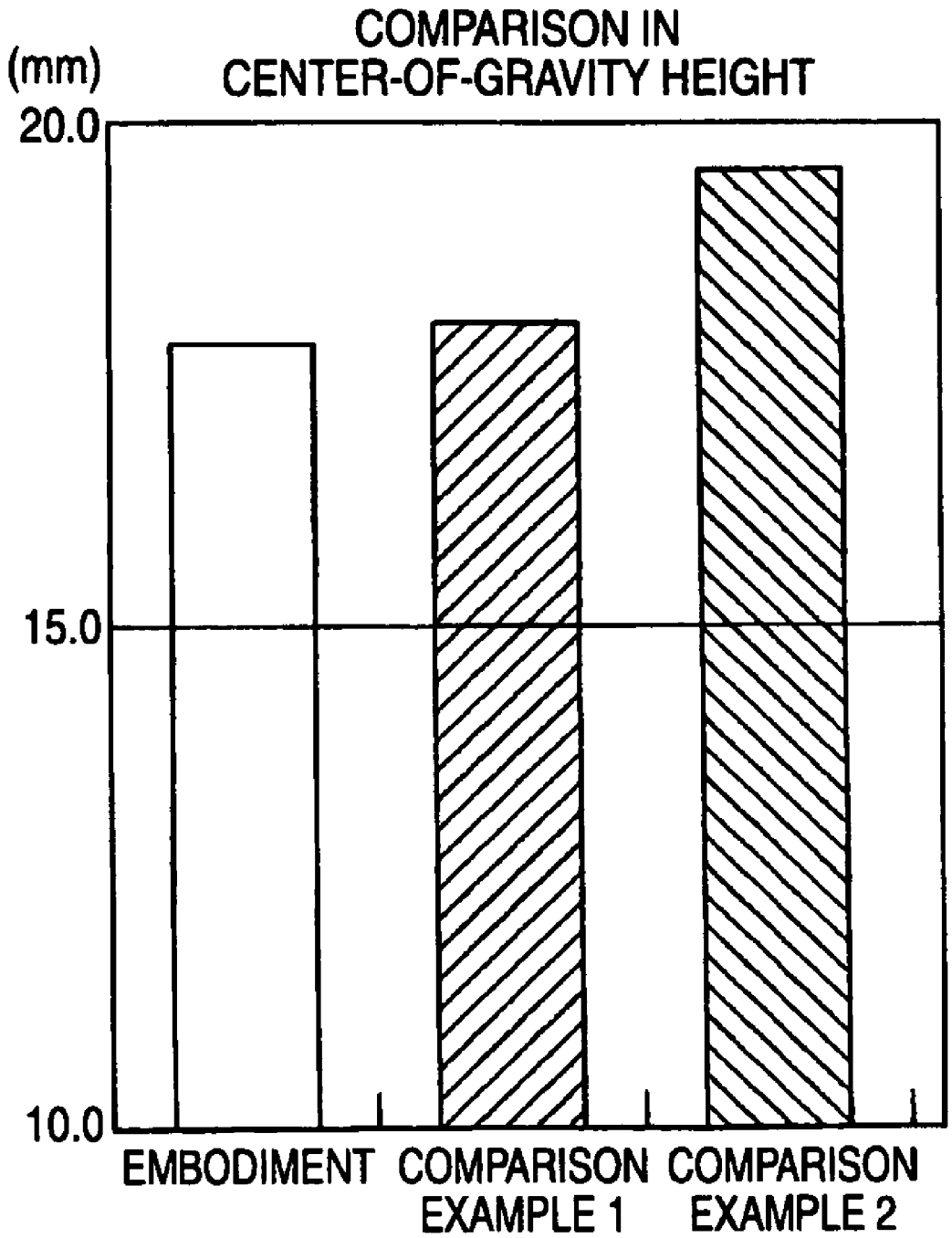
FIG. 4 is a graph comparing heads in terms of the center-of-gravity height.
Figure 5:
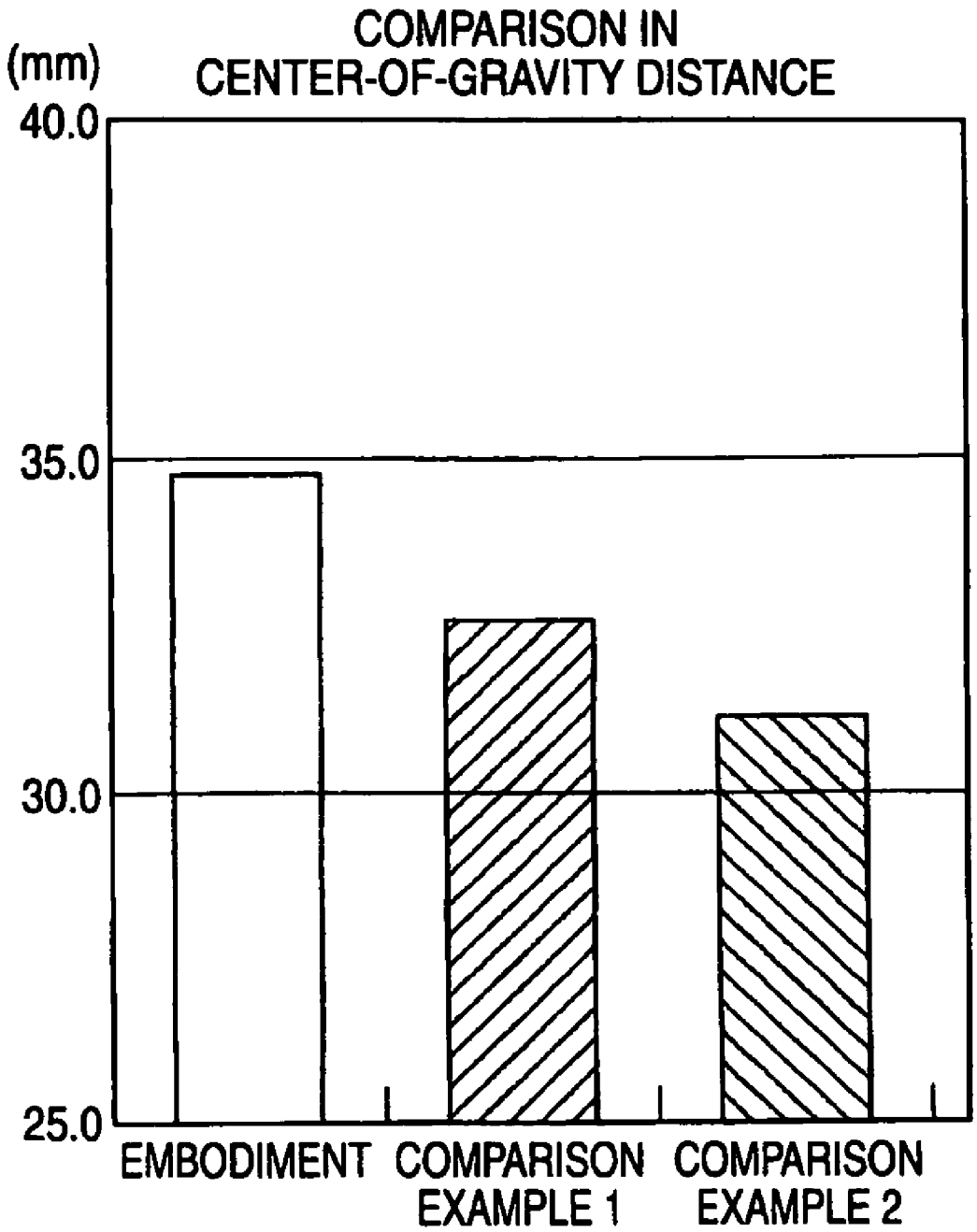
FIG. 5 is a graph comparing the heads in terms of the center-of-gravity distance.
Figure 6:
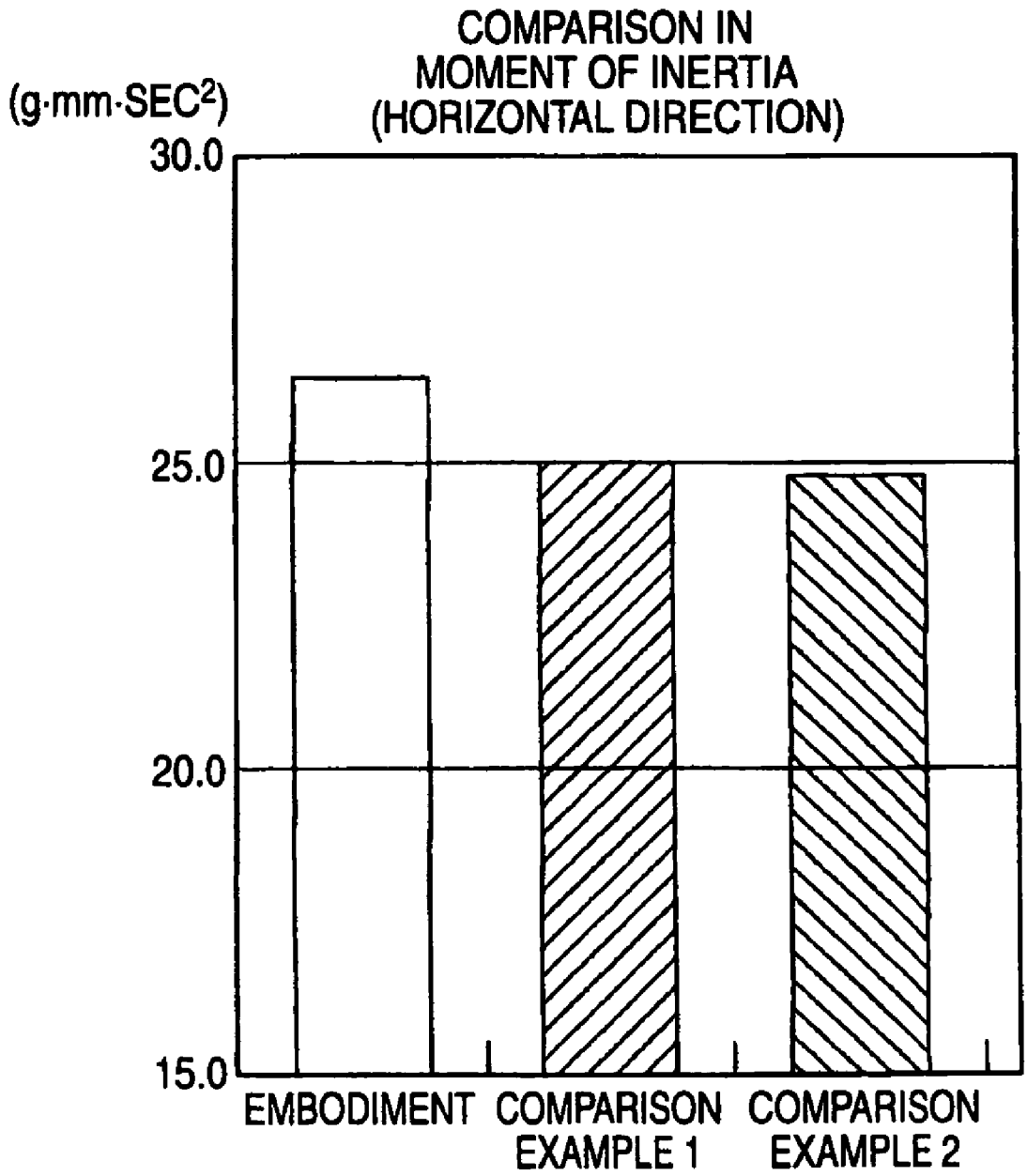
FIG. 6 is a graph comparing the heads in terms of the moment of inertia.

FIGS. 4 to 6 are graphs that compare the heads of a #3 fairway wood according to the above-described embodiment of the invention and #3 fairway woods of Comparative Examples 1 and 2 in terms of the center-of-gravity height, center-of-gravity distance, and moment of inertia, respectively. Comparative Example 1 is the head (volume: 156 $cm^3$; loft angle: 15°; body material: stainless steel) of the#3 fairway wood for experienced players (trade name: TourStage F-ST), and Comparative Example 2 is the head (volume: 170 $cm^3$; loft angle: 14°; body material: stainless steel; a tungsten weight is placed inside to shorten the center-of-gravity distance) of a #3 fairway wood (tradename: TourStage F-ST$^+$). The center of gravity of the head according to the above-described embodiment of the invention is lower than that of the head of Comparative Example 1 though the face portion of the former is taller than that of the latter. This makes it possible to realize a strong trajectory with which the ball does not fly high even when hit at a high head speed by a professional or high-level player. The center-of-gravity distance of the head according to the above-described embodiment of the invention is longer than the center-of-gravity distances of the heads of Comparative Examples 1 and 2 because the former is longer sideways than the latter. Further, the head according to the invention has a high horizontal moment of inertia and hence is superior in directional stability.

Figure 7:
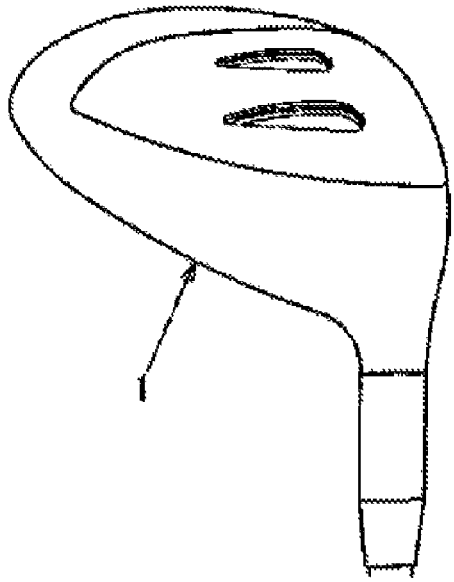
FIG. 7 is shows a wood-type golf club head according to another embodiment of the present invention.
Figure 8:
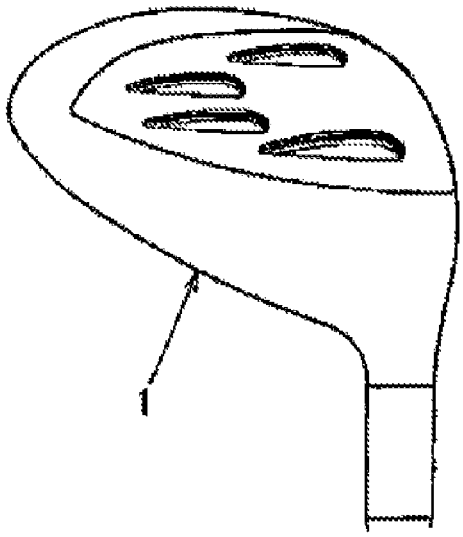
FIG. 8 is shows a wood-type golf club head according to yet another embodiment of the present invention.
Figure 9:
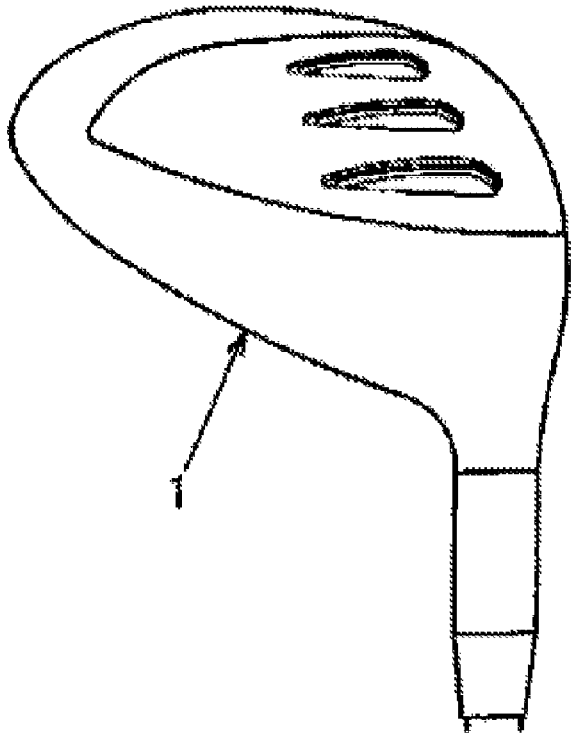
FIG. 9 is shows a wood-type golf club head according to yet another embodiment of the present invention.

Although in the above embodiment the one recess 3 is formed at the center of the sole portion 2, a pair of (i.e., right and left) recesses (e.g., FIG. 7), three (i.e., right, center, and left) recesses (e.g. FIG.9), or four or more recesses (e.g., FIG. 8) may be formed. Further, the weight member 7 and the recess 3 may have various shapes. To increase the center-of-gravity depth, they may be shaped so that more weight is allocated to a rear portion of the sole portion 2.

A golf club head according to the exemplary embodiment of the invention in which butylbromide rubber (viscoelastic body) is inserted into the sole portion 2, and a golf club according to the exemplary embodiment of the invention in which urethan-based elastomer (elastic body) is inserted into the sole portion 2 were prepared. Then, a hit feeling test was performed with using the two golf club heads according to the exemplary embodiment and the golf club heads of the comparative examples 1 and 2. As a result, in comparison with the golf club heads of the comparative examples 1 and 2, the golf club head in which the viscoelastic body is inserted provided the best hit feeling among the four golf club heads, and also the golf club head provided the second best hit feeling. This good hit feeling is caused by the elastic body and viscoelastic body.

What is claimed is:

1. A wood-type golf club head comprising:

a metal sole portion;

an elastic body; and a weight member, wherein:

two or more recesses are defined in the metal sole portion, each of the recesses extending in a front-rear direction over at least half length of a front-rear length of the sole portion, the elastic body is embedded in one of the recesses, the weight member is fixed to the one of the recesses to cover the elastic body, the weight member is flush with the sole portion, and a total area of the two or more recesses is in a range of 10% to 60% of that of the sole portion, wherein the one of the recesses has a two-step structure comprising a small recess in which the elastic body is disposed and a large recess in which the weight member is disposed.

2. The wood-type golf club head according to claim 1, wherein:

the weight member is made of a tungsten alloy, and weight member is press-fitted into the one of the recesses.

3. The wood-type golf club head according to claim 1, further comprising:

a crown portion having a thickness in a range of 0.4 mm to 0.6 mm.

4. The wood-type golf club head according to claim 1, wherein:

the sole portion includes a stainless steel, and the weight member has a specific gravity in a range of 9 to 12.

5. The wood-type golf club head according claim 1, wherein the elastic body comprises a viscoelastic body that has a loss factor equal to or larger than 0.3 in a range of −40° C. to −10° C.

6. The wood-type golf club head according claim 5, wherein the viscoelastic body comprises butylbromide rubber.

7. The wood-type golf club head according claim 1, wherein the weight member has thickness in a range between 0.5 mm to 2.5 mm.

8. The wood-type golf club head according claim 1, wherein the weight member comprises a tungsten-nickel alloy.

9. The wood-type golf club head according claim 1, wherein the weight member comprises a tungsten-copper alloy.

10. The wood-type golf club head according claim 1, wherein the metal sole portion comprises three recesses defined in the metal sole portion.

11. A wood-type golf club head comprising:

a metal sole portion;

an elastic body; and a weight member, wherein:

at least four recesses defined in the metal sole portion to extend in a front-rear direction over at least half length of a front-rear length of the sole portion, the elastic body is embedded in one of the four recesses, the weight member is fixed to the one of the four recesses to cover the elastic body, the weight member is flush with the sole portion, and a total area of the at least four recesses is in a range of 10% to 60% of that of the sole portion, wherein the one of the four recesses has a two-step structure comprising a small recess in which the elastic body is disposed and a large recess in which the weight member is disposed.

12. The wood-type golf club head according to claim 11, wherein:

the weight member is made of a tungsten alloy, and the weight member is press-fitted into the one of the four recesses.

13. The wood-type golf club head according to claim 11, further comprising:

a crown portion having a thickness in a range of 0.4 mm to 0.6 mm.

14. The wood-type golf club head according to claim 11, wherein:

the sole portion includes a stainless steel, and the weight member has a specific gravity in a range of 9 to 12.

15. The wood-type golf club head according to claim 11, wherein the elastic body comprises a viscoelastic body that has a loss factor equal to or larger than 0.3 in a range of −40° C. to −10° C.

16. The wood-type golf club head according to claim 15, wherein the viscoelastic body comprises butylbromide rubber.

17. The wood-type golf club head according to claim 11, wherein the weight member has thickness in a range between 0.5 mm to 2.5 mm.

18. The wood-type golf club head according to claim 11, wherein the weight member comprises a tungsten-nickel alloy.

19. The wood-type golf club head according to claim 11, wherein the weight member comprises a tungsten-copper alloy.

20. A wood-type golf club head comprising:

a metal sole portion;

an elastic body; and a weight member, wherein a recess is defined in the metal sole portion, the recess extending in a front-rear direction over at least half length of a front-rear length of the sole portion, the elastic body is embedded in the recess, the weight member is fixed to the recess to cover the elastic body, the weight member is flush with the sole portion, and a total area of the recess is in a range of 10% to 60% of that of the sole portion, wherein the recess has a two-step structure comprising a small recess in which the elastic body is disposed and a large recess in which the weight member is disposed.

* * * * *